US007821205B2

(12) United States Patent
Chu et al.

(10) Patent No.: US 7,821,205 B2
(45) Date of Patent: Oct. 26, 2010

(54) FLAT DISPLAY PANEL HAVING EXHAUST HOLES WITHIN DISPLAY AREA

(75) Inventors: Jeong Keun Chu, Gumi-si (KR); Sang Yong Ahn, Gumi-si (KR)

(73) Assignee: Orion PDP Co., Ltd. (KR)

( * ) Notice: Subject to any disclaimer, the term of this patent is extended or adjusted under 35 U.S.C. 154(b) by 345 days.

(21) Appl. No.: 11/666,646

(22) PCT Filed: Aug. 12, 2005

(86) PCT No.: PCT/KR2005/002632

§ 371 (c)(1),
(2), (4) Date: Apr. 30, 2007

(87) PCT Pub. No.: WO2006/049386

PCT Pub. Date: May 11, 2006

(65) Prior Publication Data

US 2008/0074030 A1 Mar. 27, 2008

(30) Foreign Application Priority Data

Nov. 1, 2004 (KR) ..... 10-2004-0087962

(51) Int. Cl.
*H01J 17/49* (2006.01)
*H01J 9/38* (2006.01)

(52) U.S. Cl. ..... 313/583; 313/581; 313/582; 313/584; 445/25; 445/70

(58) Field of Classification Search ..... 313/582–587; 315/169.1, 169.4, 37, 41, 60, 71; 345/37, 345/41, 60, 71; 445/24–26, 70
See application file for complete search history.

(56) References Cited

U.S. PATENT DOCUMENTS 3,588,874 A * 6/1971 Huborn et al. ..... 345/71

(Continued)

FOREIGN PATENT DOCUMENTS

GB 2 261 320 A 5/1993

(Continued)

OTHER PUBLICATIONS

International Search Report dated Nov. 17, 2005 from corresponding PCT/KR2005/002632.

(Continued)

*Primary Examiner*—Sikha Roy
*Assistant Examiner*—Jose M Diaz
(74) *Attorney, Agent, or Firm*—Ohlandt, Greeley, Ruggiero & Perle, LLP

(57) ABSTRACT

A flat display panel comprising exhaust holes in a display region is provided. In the flat display panel, a front substrate comprising X and Y electrodes a rear substrate comprising an address electrode are sealed at a predetermined interval in parallel. Vacuum exhaust and gas discharge are performed on a space between the sealed substrates through the exhaust holes in the display area, thereby reducing a non-radiation area of the panel to less than 1 mm. As a result, the flat display panel is effective in formation of an indefinite extension multi-PDP because a seam between the panels is removed when a multi-PDP comprising a plurality of panels is formed.

13 Claims, 3 Drawing Sheets

U.S. PATENT DOCUMENTS

| | | | | |
|---|---|---|---|---|
| 3,849,686 | A * | 11/1974 | Miyazaki | 313/484 |
| 6,236,159 | B1 * | 5/2001 | Inoue et al. | 313/582 |
| 6,411,034 | B1 | 6/2002 | Cho et al. | |
| 6,554,672 | B2 | 4/2003 | Dunham et al. | 445/25 |
| 6,840,833 | B1 * | 1/2005 | Motowaki et al. | 445/25 |
| 6,873,389 | B2 * | 3/2005 | Ikeya et al. | 349/153 |
| 6,997,769 | B2 | 2/2006 | Sacki | 445/70 |
| 7,407,902 | B2 * | 8/2008 | Hasegawa et al. | 501/15 |
| 7,456,572 | B2 * | 11/2008 | Hong et al. | 313/582 |
| 2002/0059977 | A1 * | 5/2002 | Igeta | 156/182 |
| 2003/0102804 | A1 * | 6/2003 | Mitomo | 313/586 |
| 2003/0227252 | A1 * | 12/2003 | Ikeya et al. | 313/495 |
| 2004/0150337 | A1 * | 8/2004 | Shiokawa et al. | 313/582 |
| 2005/0093446 | A1 * | 5/2005 | Hong et al. | 313/582 |
| 2005/0099124 | A1 * | 5/2005 | Chen et al. | 313/582 |
| 2006/0066238 | A1 * | 3/2006 | Woo | 313/582 |
| 2006/0132037 | A1 * | 6/2006 | Okawa et al. | 313/582 |
| 2006/0152156 | A1 * | 7/2006 | Hasegawa et al. | 313/582 |

FOREIGN PATENT DOCUMENTS

| | | | |
|---|---|---|---|
| JP | 2000-243315 | A | 9/2000 |
| JP | 2001-325889 | A | 11/2001 |
| JP | 2003-346664 | A | 12/2003 |
| JP | 2004-200117 | A | 7/2004 |
| JP | 2005-183125 | A | 7/2005 |
| KR | 2001-77467 | A | 10/2001 |
| RU | 2 063 066 | C1 | 6/1996 |
| RU | 2 188 460 | C2 | 8/2002 |

OTHER PUBLICATIONS

Supplementary European Search Report corresponding to European Patent No. EP 05 773 873.4 dated May 18, 2008.
Decision on Grant dated Jan. 12, 2010.

* cited by examiner

[Fig. 1]
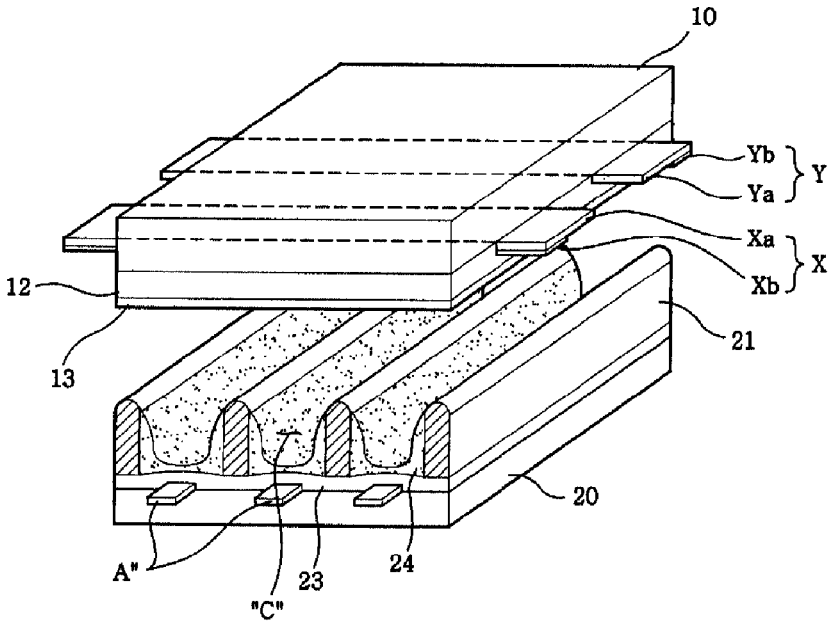
[Fig. 2]
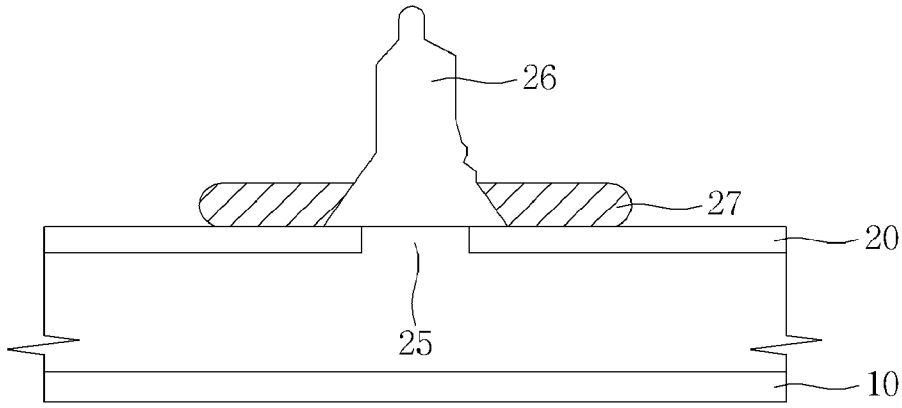
[Fig. 3]
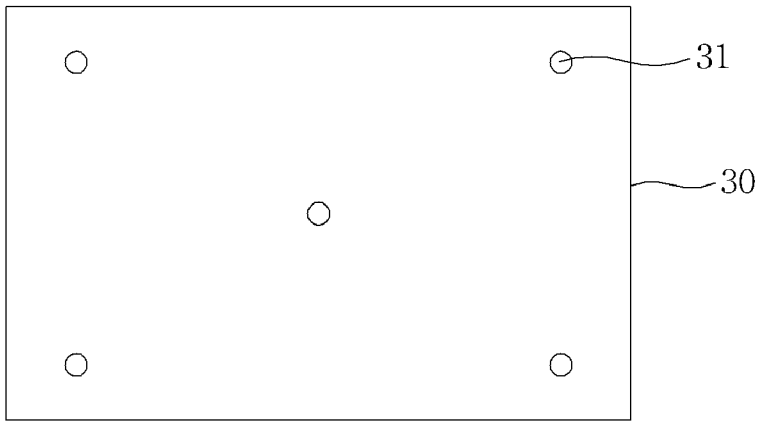

[Fig. 4]
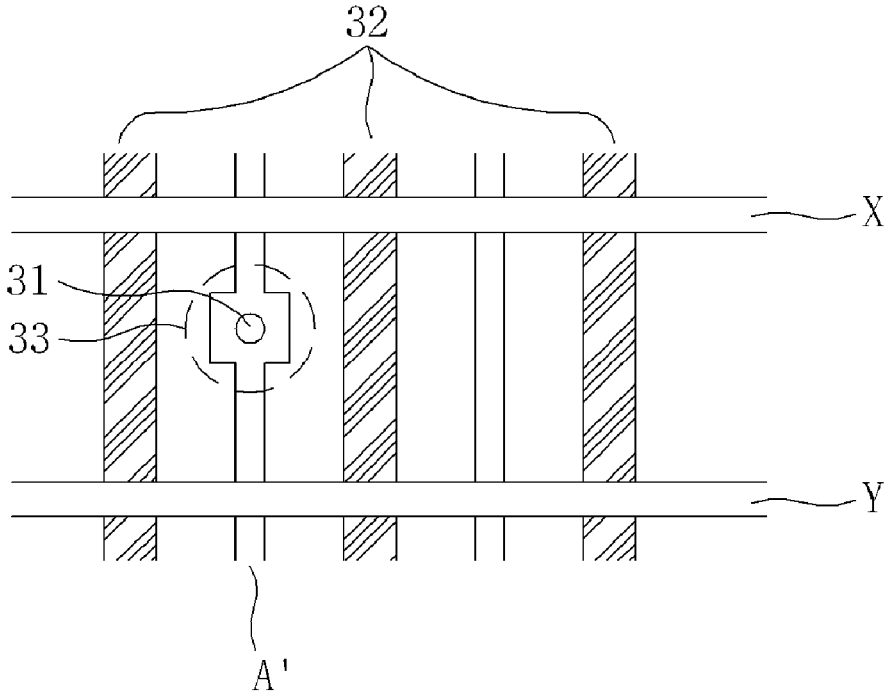
[Fig. 5]
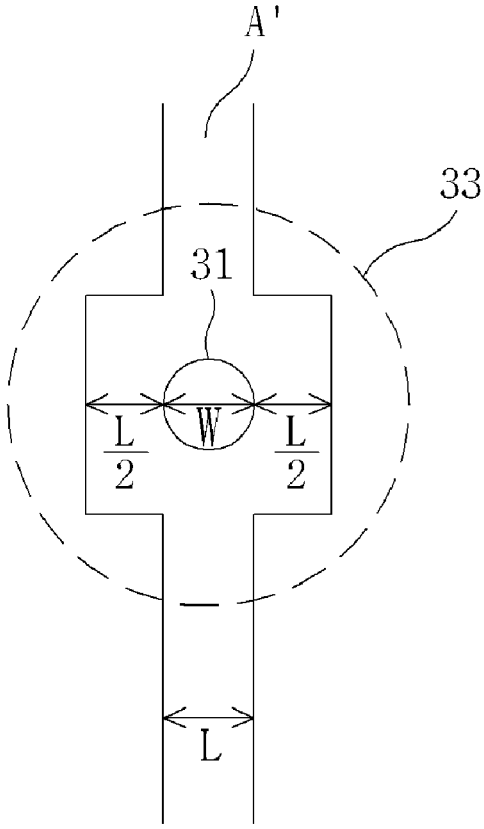

[Fig. 6]
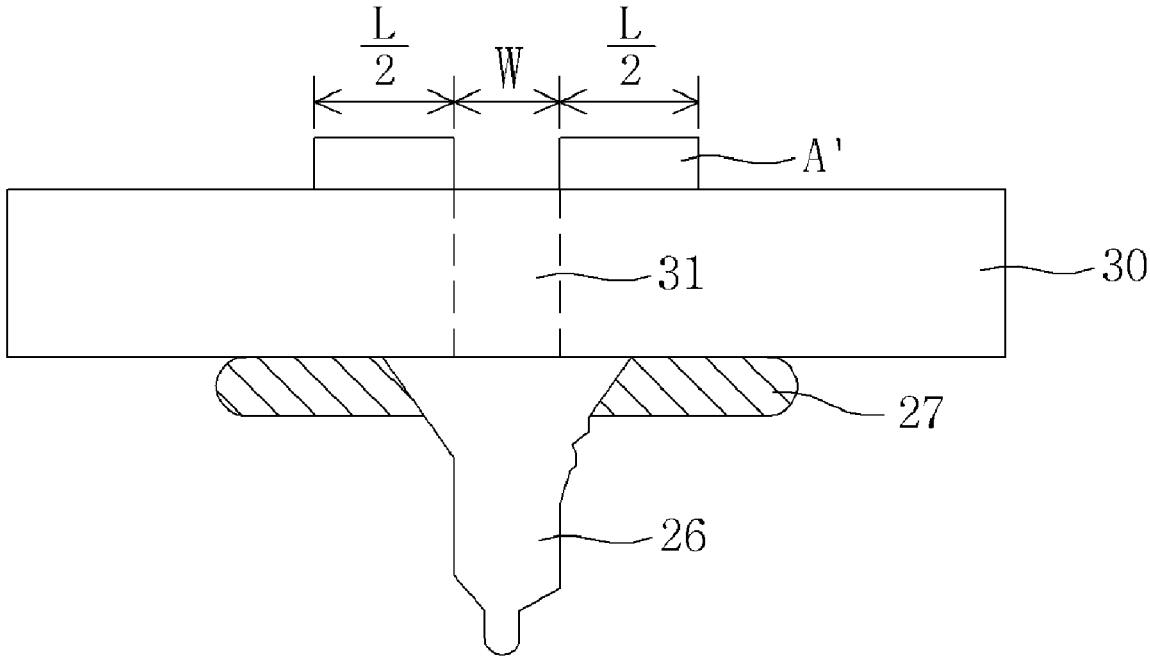
[Fig. 7]
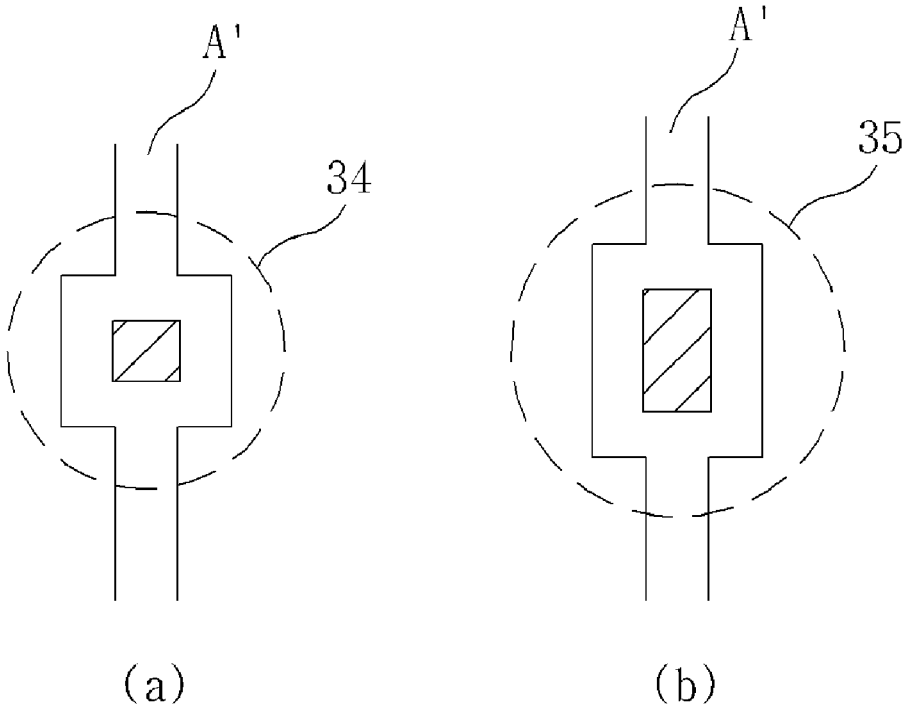

FLAT DISPLAY PANEL HAVING EXHAUST HOLES WITHIN DISPLAY AREA

TECHNICAL FIELD

The present invention generally relates to a flat display panel, and more specifically, to a plasma display panel (hereinafter, referred to as "PDP") comprising exhaust holes each positioned in a random region of a display area for vacuum exhaust and gas charge from/to a space between substrates.

BACKGROUND ART

A PDP is formed by injecting gas into a cell between two substrates comprising transparent electrodes each having a predetermined pattern. When a discharge voltage is applied to the cell where the gas is injected and sealed, a fluorescent substance is excited by ultraviolet rays generated from the discharge voltage to embody figures, letters or graphic.

FIG. 1 is an exploded perspective view illustrating a structure of a general PDP.

In the general PDP, a front substrate 10 where a electrode X (sustain electrode) and a electrode Y (scan electrode) are formed and a rear substrate 20 where an address electrode is formed are sealed at a predetermined distance in parallel.

The electrodes X and Y in the front substrate 10 sustain radiation generated by discharge in the cell selected at an address period. The electrodes X and Y are formed of transparent electrode (or ITO electrode) Xa and Ya that are made by transparent ITO materials and of bus electrodes Xb and Yb that are made by metal materials. The electrodes X and Y are covered by a dielectric layer 12 for limiting discharge current and insulating the electrodes. A protective film 13 such as a MgO film is formed on the dielectric layer 12.

The rear substrate 20 comprises barriers 21 arranged in parallel as a stripe type (or dot type) for forming cells C which are discharge spaces. Also, the rear substrate 20 comprises address electrodes A arranged in parallel with the barrier 21 and crossed with the electrodes X and Y. A dielectric layer 23 is formed on the address electrode A. Then, a R.G.B fluorescent layer 24 for emitting visible rays at address discharge to display image is coated on the upper surface of the rear substrate 20 except the top surface of the barrier 21.

For charging discharge gas in the above-described PDP, a sealing unit 27 is formed between the front substrate 10 and the rear substrate 20 so as to maintain airtightness between the front substrate 10 and the rear substrate 20. Then, vacuum exhaust is performed on the inside of the PDP, and discharge gas is charged in the vacuum-exhausted space.

As shown in FIG. 2, an exhaust hole 25 is formed on the rear substrate 20. Next, the rear substrate 20 and an exhaust small tube 26 are seamed using the sealing unit 27, so that the exhaust small tube 26 is safely positioned on the exhaust hole 25. As a result, gas exhaust and discharge gas injection in the panel are performed through the exhaust small tube 26.

However, in the conventional PDP, the exhaust hole 25 is located at the outside of the display area. Although the location of the exhaust hole 25 does not matter in case of the PDP consisting of a single panel, there is a limit in reduction of a seam between panels when a multi-PDP comprising a plurality of PDP panels for a large screen is embodied. That is, when the exhaust hole 25 is formed at the outside of the display area, the seam of the indefinite extension multi-PDP cannot be reduced to less than several cms in consideration of precision of the location of the exhaust hole 25 and the diameter of the exhaust small tube 26.

DISCLOSURE OF INVENTION

Technical Problem

It is an object of the present invention to form an exhaust hole in a display area of a PDP, thereby reducing an outer area of the display area that does not contribute to image embodiment.

Technical Solution

In an embodiment, a flat display panel comprises a front substrate comprising X and Y electrodes and a rear substrate comprising an address electrode which are sealed in parallel at a predetermined interval, where vacuum exhaust and gas charge are performed on a space between the sealed substrates through one or more exhaust holes. Preferably, the one or more exhaust holes are formed in a display area.

Moreover, each exhaust hole is formed to perforate the address electrode in a corresponding cell area. When a plurality of exhaust holes are formed, exhaust holes are formed symmetrically on a basis of the center of the display area.

According to one aspect of the present invention, the address electrode which has the exhaust hole comprises an exhaust hole electrode unit having a locally wide-formed portion where the exhaust hole is formed.

According to another aspect of the present invention, the exhaust hole electrode unit has a width obtained by adding a width of the address electrode to a width or a diameter of the exhaust hole, and the exhaust hole is formed in the middle of the exhaust hole electrode unit.

According to still another aspect of the present invention, the exhaust hole is formed to be circular or polygonal.

BRIEF DESCRIPTION OF THE DRAWINGS

The above and other objects, features and other advantages of the present invention will be more clearly understood from the following detailed description taken in conjunction with the accompanying drawings, in which:

FIG. 1 is an exploded perspective view illustrating a structure of a general PDP;

FIG. 2 is a cross-sectional diagram illustrating an exhaust small tube formed on a rear substrate of FIG. 1;

FIG. 3 is a diagram illustrating a plurality of circular exhaust holes formed in a display area of a plasma display panel according to an embodiment of the present invention;

FIG. 4 is a diagram illustrating an enlarged electrode structure where the exhaust hole is formed;

FIG. 5 is an enlarged diagram illustrating a structure of an exhaust hole electrode of FIG. 4;

FIG. 6 is a cross-sectional diagram illustrating the rear substrate where the exhaust hole electrode 33 shown in FIG. 5 is formed; and FIG. 7 is a diagram illustrating an exhaust hole according to an embodiment of the present invention.

BEST MODE FOR CARRYING OUT THE INVENTION

The present invention will be described in detail with reference to the accompanying drawings.

FIG. 3 is a diagram illustrating a plurality of circular exhaust holes formed in a display area of a plasma display panel according to an embodiment of the present invention. FIG. 4 is a diagram illustrating an enlarged electrode structure where the exhaust hole is formed.

In this embodiment, when vacuum exhaust and gas charge are performed on the inside of the display panel, a plurality of exhaust holes 31 (five exhaust holes in the embodiment of the present invention) are formed symmetrically in the display area as shown in FIG. 3, so that the vacuum exhaust and gas charge are uniformly performed on the entire display region.

Since the exhaust holes 31 are formed in the display area, a non-radiation region which does not contribute to image embodiment can be reduced to less than 1 mm. As a result, a size of a rear substrate 30 becomes identical with that of the display area as shown in FIG. 3.

Here, each exhaust hole 31 can be formed in a random cell C area that a manufacturer desires regardless of colors of R/G/B pixels, and its size is formed smaller than the corresponding pixel. That is, when the size of the exhaust hole 31 is larger than the corresponding pixel, a corresponding cell can be an off cell where discharge does not occurs constantly. Accordingly, the size of the exhaust hole 31 is formed to be smaller than that of the R/G/B pixel for facilitating fluorescent coating. Although the size of the exhaust hole 31 is smaller than the pixel, when the exhaust hole 31 penetrates an address electrode of the corresponding cell C, a corresponding address electrode may be disconnected or an electrode width becomes narrower in a corresponding area. As a result, sufficient discharge cannot be performed, and precise alignment cannot be performed on the corresponding cell.

To solve the above-described problem, a width of an electrode where the exhaust hole 31 is formed in an address electrode A' (hereinafter, referred to as 'exhaust hole electrode' 33) is formed to be locally wide. Preferably, the exhaust hole 31 is formed to perforate the middle portion of the exhaust hole electrode 33. As shown in FIG. 5, when a width of the address electrode A' is L and a diameter of the exhaust hole 31 is W, a width of the exhaust hole electrode 33 becomes L+W, and the exhaust hole 31 is formed at its middle portion. Here, a length of the exhaust hole electrode 33 can be identical with the width of the exhaust hole electrode 33 when the exhaust hole 31 is formed to be circular. When the exhaust hole 31 is formed to be oval in a length direction, the length of the exhaust hole electrode 33 can be formed to be longer that its width in proportion to the diameter of the major axis of the exhaust hole 31. Also, when the exhaust hole 31 is formed to be oval, the width of the exhaust hole electrode 33 can be formed to be narrower than when the exhaust hole 31 is formed to be circular in a range where the size of the circle is identically maintained.

FIG. 6 is a cross-sectional diagram illustrating the rear substrate where the exhaust hole electrode 33 shown in FIG. 5 is formed.

As shown in FIGS. 5 and 6, the exhaust hole 31 according to the embodiment of the present invention is formed to enlarge an alignment deviation margin between the electrode and the barrier 32 and to facilitate a process at the same time.

Although the exhaust hole 31 formed to be circular or oval is exemplified in the above-described embodiment, the shape of the exhaust hole can be variously changed within a range which does not affect the vacuum exhaust and the gas charge.

FIG. 7 is a diagram illustrating an exhaust hole according to an embodiment of the present invention.

FIGS. 7*a* and 7*b* show that an exhaust hole is formed to be a regular square and a rectangle, respectively.

As the method described in FIG. 5, a width of exhaust holes 34 and 35 is obtained by adding a width of a corresponding square to that of an address electrode A'. When the exhaust hole is formed to be a rectangle as shown in FIG. 7*b*, the width of the exhaust hole electrode 35 can be formed to be narrower than that of the exhaust hole 34 of FIG. 7*a*.

In this embodiment, the exhaust hole can be formed to have a polygonal shape having various angles such as a triangle or a pentagon other than the rectangle or the square of FIG. 7 depending on a manufacturing process.

Although the example where the 5 exhaust holes 31 are formed in the display area of each panel is illustrated in the above-described embodiment, the number of the exhaust holes 31 can be properly regulated if necessary.

INDUSTRIAL APPLICABILITY

Accordingly, exhaust holes for vacuum exhaust and gas charge are formed in a display area, so that a non-radiation area of a panel is reduced to less than 1 mm. Thus, since a seam between panels can be removed in a multi-PDP where a plurality of panels are connected, it is effective to form an indefinite extension PDP.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A flat display panel comprising a front substrate comprising X and Y electrodes and a rear substrate comprising an address electrode which are sealed in parallel at a predetermined interval, where vacuum exhaust and gas charge are performed on a space between the sealed substrates through one or more exhaust holes, wherein the one or more exhaust holes are formed on the rear substrate in a display area.

2. The flat display panel according to claim 1, wherein each of the one or more exhaust holes is formed to perforate the address electrode in a corresponding cell area.

3. The flat display panel according to claim 2, wherein the address electrode which has the exhaust hole comprises an exhaust hole electrode unit having a locally wide-formed portion where the exhaust hole is formed.

4. The flat display panel according to claim 1, wherein one of the one or more exhaust holes is formed to have a circular shape.

5. The flat display panel according to claim 4, further comprising an exhaust hole electrode unit having a portion where one of the one or more exhaust holes is formed, wherein the exhaust hole electrode unit has a width obtained by adding a width of the address electrode to a width or a diameter of the one exhaust hole, and the one exhaust hole is formed in the middle of the exhaust hole electrode unit.

6. The flat display panel according to claim 1, wherein the one or more exhaust holes is a plurality of exhaust holes and wherein when the plurality of the exhaust holes are formed, the plurality of exhaust holes are formed symmetrically on a basis of the center of the display area.

7. The flat display panel according to claim 2, wherein each of the one or more the exhaust holes is formed to have a circular shape.

8. The flat display panel according to claim 2, wherein each of the one or more the exhaust holes is formed to have a polygonal shape.

9. The flat display panel according to claim 7, further comprising an exhaust hole electrode unit having a portion where one of the one or more exhaust holes is formed, wherein the exhaust hole electrode unit has a width obtained by adding a width of the address electrode to a width of the one exhaust hole, and the one exhaust hole is formed in the middle of the exhaust hole electrode unit.

10. The flat display panel according to claim 3, wherein the exhaust hole is formed to have a circular shape.

11. The flat display panel according to claim 3, wherein the exhaust hole is formed to have a polygonal shape

12. The flat display panel according to claim 10, further comprising an exhaust hole electrode unit having a portion where the exhaust hole is formed, wherein the exhaust hole electrode unit has a width obtained by adding a width of the address electrode to a width of the exhaust hole, and the exhaust hole is formed in the middle of the exhaust hole electrode unit.

13. The flat display panel according to one of claim 1, wherein one of the one or more exhaust holes is formed to have a polygonal shape.

* * * * *